US007067968B2

(12) United States Patent
Ha et al.

(10) Patent No.: US 7,067,968 B2
(45) Date of Patent: Jun. 27, 2006

(54) CATHODE RAY TUBE HAVING SUPPORT MEMBER FOR COLOR SELECTION APPARATUS

(75) Inventors: Kuen-Dong Ha, Seongnam (KR); Joon-Seong Park, Suwon (KR); Chan-Yong Kim, Incheon (KR); Sang-Hoon Lee, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 178 days.

(21) Appl. No.: 10/627,567

(22) Filed: Jul. 24, 2003

(65) Prior Publication Data

US 2004/0017144 A1 Jan. 29, 2004

(30) Foreign Application Priority Data

Jul. 26, 2002 (KR) ..... 10-2002-0044201

(51) Int. Cl.
*H01J 29/02* (2006.01)
*H01J 29/07* (2006.01)

(52) U.S. Cl. ..... 313/404; 313/407; 313/402

(58) Field of Classification Search ..... 313/404, 313/402, 405, 406, 407, 408
See application file for complete search history.

(56) References Cited

U.S. PATENT DOCUMENTS 3,803,436 A * 4/1974 Morrell ..... 313/405
6,271,624 B1 8/2001 Taguchi et al.
6,288,480 B1 * 9/2001 Takano et al. ..... 313/407
6,700,318 B1 * 3/2004 Baek ..... 313/402

FOREIGN PATENT DOCUMENTS

JP 09-231913 9/1997
JP 11-219664 * 8/1999

* cited by examiner

*Primary Examiner*—Karabi Guharay
(74) *Attorney, Agent, or Firm*—Christie, Parker and Hale, LLP

(57) ABSTRACT

A cathode ray tube includes a color selection apparatus mounted between a phosphor screen and an electron gun, and support members for supporting the color selection apparatus. Each of the support members is formed by a spring including a fixed section secured to the color selection apparatus, a locking section connected to the cathode ray tube, and a center section formed between these elements. The fixed section and the center section are separated by and bent at a first folding trace, and the center section and the locking section are separated by and bent at a second folding trace. Also, if a direction along a width of the springs is X, the first folding trace has an angle $\theta_1$ with a straight line drawn on the fixed section along direction X, and the second folding trace has an angle $\theta_2$ with a straight line drawn on the center section along direction X, the angle $\theta_2$ is greater than the angle $\theta_1$.

19 Claims, 4 Drawing Sheets

CATHODE RAY TUBE HAVING SUPPORT MEMBER FOR COLOR SELECTION APPARATUS

CROSS REFERENCE TO RELATED APPLICATIONS

This application claims priority to and the benefit of Korean Patent Application No. 2002-0044201 filed on Jul. 26, 2002 in the Korean Intellectual Property Office, the entire disclosure of which is incorporated herein by reference.

BACKGROUND OF THE INVENTION (a) Field of the Invention

The present invention relates to a cathode ray tube, and more particularly, to a cathode ray tube having a support member that enables mounting of a color selection apparatus to an inner area of a panel in which a phosphor screen is formed.

(b) Description of the Related Art

A cathode ray tube (CRT) is typically a display device in which three electron beams emitted from an electron gun strike R, G, and B phosphors of a phosphor screen to illuminate the phosphors and realize predetermined images. The CRT includes a panel having the phosphor screen, a neck in which the electron gun that emits electron beams toward the phosphor screen is mounted, and a funnel that interconnects the panel and neck. A deflection apparatus for deflecting the electron beams is mounted to an outer circumference of the funnel.

In such a CRT, the color selection apparatus is mounted to an inner area of the panel. The color selection apparatus performs a color separation function such that the electron beams emitted from the electron gun are separated to land on desired phosphors. The color selection apparatus includes a shadow mask that separates the electron beams, a mask frame for supporting the shadow mask, and a support member that secures the mask frame to the inner area of the panel.

The shadow mask of the color selection apparatus is formed by performing a photolithography process on aluminum-killed steel or Invar steel of an extremely small thickness to form a plurality of electron beam passage apertures, after which drawing is performed to realize the final desired form. Since the thickness of the shadow mask is extremely small relative to its area, and because of the formation of tens of thousands of the apertures, the shadow mask becomes structurally weak. This leads to the shadow mask sinking inwardly after receiving an outside shock, or undergoing thermal expansion (i.e., doming phenomenon) toward the phosphor screen as a result of the electron beams that do not pass through the apertures and instead strike the shadow mask.

To overcome this problem and also enable manufacturing of larger screen sizes and flatter profiles, tension masks have been developed that are fixed to a frame of a predetermined structure while in a state of tension. An example of a CRT that uses a tension mask is disclosed in U.S. Pat. No. 6,271,624.

However, in the CRT using the tension mask, doming as with the conventional shadow mask nevertheless occurs, which causes mislanding of electron beams. This is a result of the tension mask being heated by the electron beams that do not pass through electron beam apertures and strike the tension mask. That is, the heat generated in the tension mask is transmitted to the frame that supports the mask such that the frame undergoes thermal expansion.

To prevent this problem, the CRT having the tension mask uses support members for securing the frame that mounts the tension mask to the panel. Each of the support members includes a spring holder (or hook), one end of which is welded to the frame; and a spring having one end welded to the spring holder and its other end fastened to the spring holder mounted to an inner surface of the panel. Each of the spring holders is formed of a bi-metal member, in which a high expansion member and a low expansion member having different thermal expansion coefficients are connected aligned in a lengthwise direction.

With the support member having such a structure, the spring holders are thermally deformed by the bi-metal characteristics when the frame undergoes thermal expansion. Therefore, movement of the frame caused by its thermal expansion is compensated for by the spring holders to ensure that the tension mask remains at its intended, original position. This prevents mislanding of the electron beams by thermal expansion of the frame. However, the bi-metal members forming the spring holders are high in cost and difficult to work with during manufacturing. This increases overall manufacturing costs of the CRT.

In Japanese Laid-Open Patent No. Heisei 9-231913, a CRT that does not use costly bi-metal parts and that has plate-shaped support members for preventing the mislanding of electron beams is disclosed. In this disclosure, the support members include welding sections that are welded to the color separation apparatus, locking sections suspended from and connected to the panel on which the phosphor screen is formed, and center sections interconnecting the welding sections and the locking sections. The welding sections, locking sections, and center sections are partitioned by a pair of folding traces, which are provided in parallel and at a predetermined angle with a direction along a width of the support member.

If the frame undergoes thermal expansion, the deformation of the support members structured in this manner follows the thermal expansion of the frame. This therefore compensates for position changes that would cause mislanding.

However, with such support members, an area of the welding sections, which are supported by hooks and fixed together with the hooks on the color separation apparatus, occupies a significant portion of the entire area of the support members. As a result, the welding sections limit the range of operation of other areas when the support members are operating. This reduces the effectiveness of operation of the support members.

To overcome this problem, Japanese Laid-Open Patent No. Heisei 11-219664 discloses a structure in which, while using the above conventional structure of the support member, two folding traces for compensating for a slant of a plane surface of the locking sections, which oppose the plane surface of the welding sections, are formed in the locking sections.

However, in this disclosure, based on folding traces defining the welding sections and center sections according to a plurality of folding traces established on the support member, the support member (excluding the welding sections) moves freely about the remaining folding traces. As a result, the support members do not operate according to design specifications when applied to the CRT.

Further, there are problems in the processes involved as a result of a plurality of folding traces being designed on the support members. That is, since it is necessary to bend the support members repeatedly, manufacturing becomes complicated. Also, when the support members are formed by bending, it is difficult to bend the support members within a range to avoid breaking of the support members and to determine the bending angle when considering the high strength of the material used for the support member.

SUMMARY OF THE INVENTION

In one embodiment, the present invention is a cathode ray tube including a color selection apparatus mounted between a phosphor screen and an electron gun, which are installed within a vacuum tube assembly of the cathode ray tube, and one or more support members for supporting the color selection apparatus in the vacuum tube assembly. Each of the support members is formed by a spring including a fixed section secured to the color selection apparatus, a locking section connected to the vacuum tube assembly, and a center section formed between the fixed section and the locking section, The fixed section and the center section are separated by and bent at a first folding trace, and the center section and the locking section are separated by and bent at a second folding trace. If a direction along a width of the springs is X, a direction along a length of the springs is Y, the first folding trace has an angle $\theta_1$ with a straight line drawn on the fixed section along direction X, and the second folding trace has an angle $\theta_2$ with a straight line drawn on the center section along direction X, the angle $\theta_2$ is greater than the angle $\theta_1$.

A bending direction between the fixed section and the center section is opposite to a bending direction between the center section and the locking section.

Each of the support members further includes a holder that is fixed to the color selection apparatus and to the corresponding fixed section, and the fixed section is welded to the holders.

In each member the first folding trace is formed in an outside area of the support member making contact with the holders.

The locking section includes a connecting hole, and the connecting hole is secured to a stud pin mounted to an inner surface of the panel of the vacuum tube assembly. The connecting hole is circular, and a distance of a straight line that passes through a center of the connecting hole and is perpendicular to the second folding trace is 5 mm or greater in length.

If a length along direction X of the spring from a plane of the fixed section to a corner of a plane of the locking sections is h1, and a length along direction X of the spring from the plane of the fixed section to a corner of a plane of the locking section is h2, the following condition is satisfied:

$$1\ \text{mm} \leqq h_2 - h_1 \leqq 5\ \text{mm}.$$

The angle $\theta_1$ satisfies the following condition:

$$0° < \theta_1 \leqq 45°.$$

Also, the angle $\theta_2$ satisfies the following condition:

$$30° \leqq \theta_2 \leqq 70°.$$

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION

An exemplary embodiment of the present invention will now be described in detail with reference to the accompanying drawings.

Figure 1:
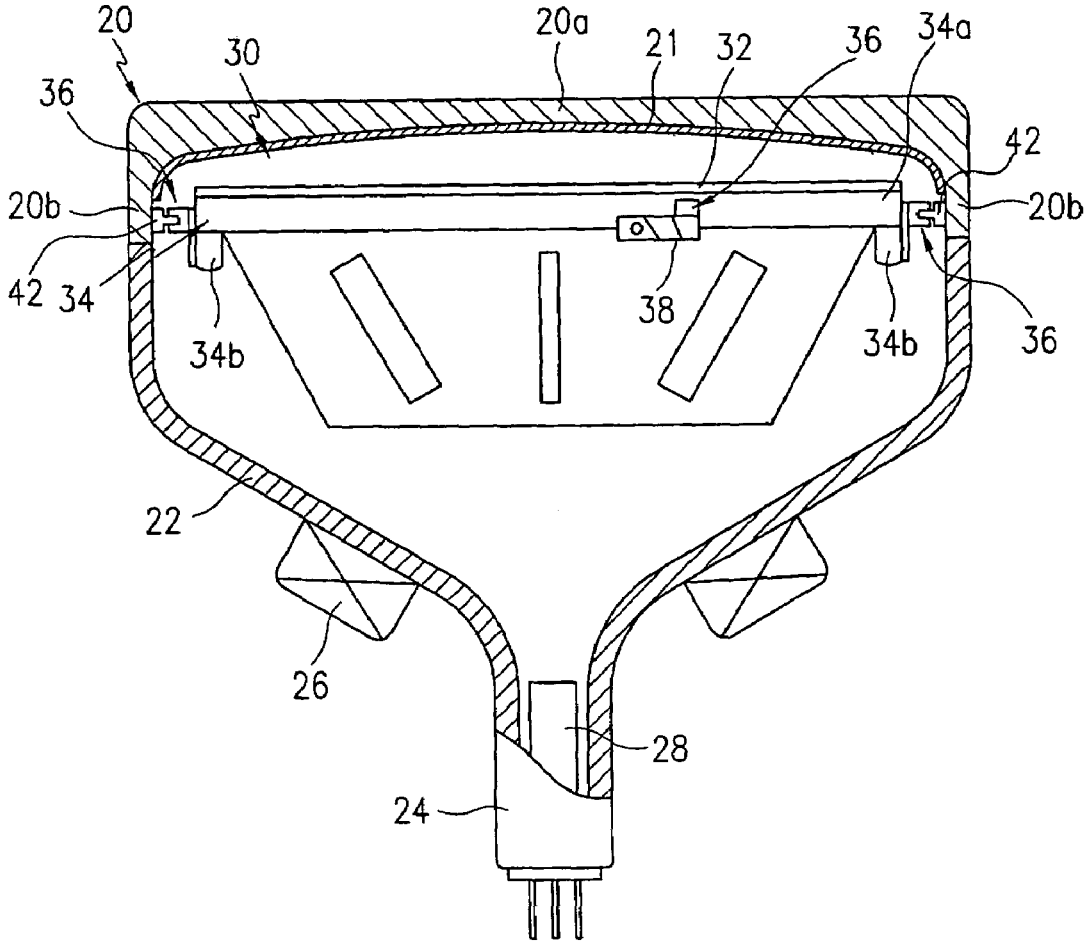
FIG. 1 is a sectional view of a cathode ray tube according to an embodiment of the present invention.

FIG. 1 is a sectional view of a cathode ray tube according to an embodiment of the present invention. The cathode ray tube (CRT) includes a panel 20 having a phosphor screen 21 formed on an inner surface of a screen section 20*a*, and having a side wall 20*b* formed extending a predetermined distance and at a predetermined angle from the screen section 20*a*. A funnel 22 is connected to the panel 20 (i.e., the side wall 20*b* of the panel 20) and a neck 24 is connected to the funnel 22. The panel 20, the funnel 22, and the neck 24 form a vacuum tube assembly that defines an exterior of the CRT.

A deflection apparatus 26 is mounted to an outer circumference of the funnel 22, and an electron gun 28 is mounted within the neck 24. The electron gun 28 emits electrons that form electron beams, and the deflection apparatus 26 deflects the formed electron beams.

Figure 2:
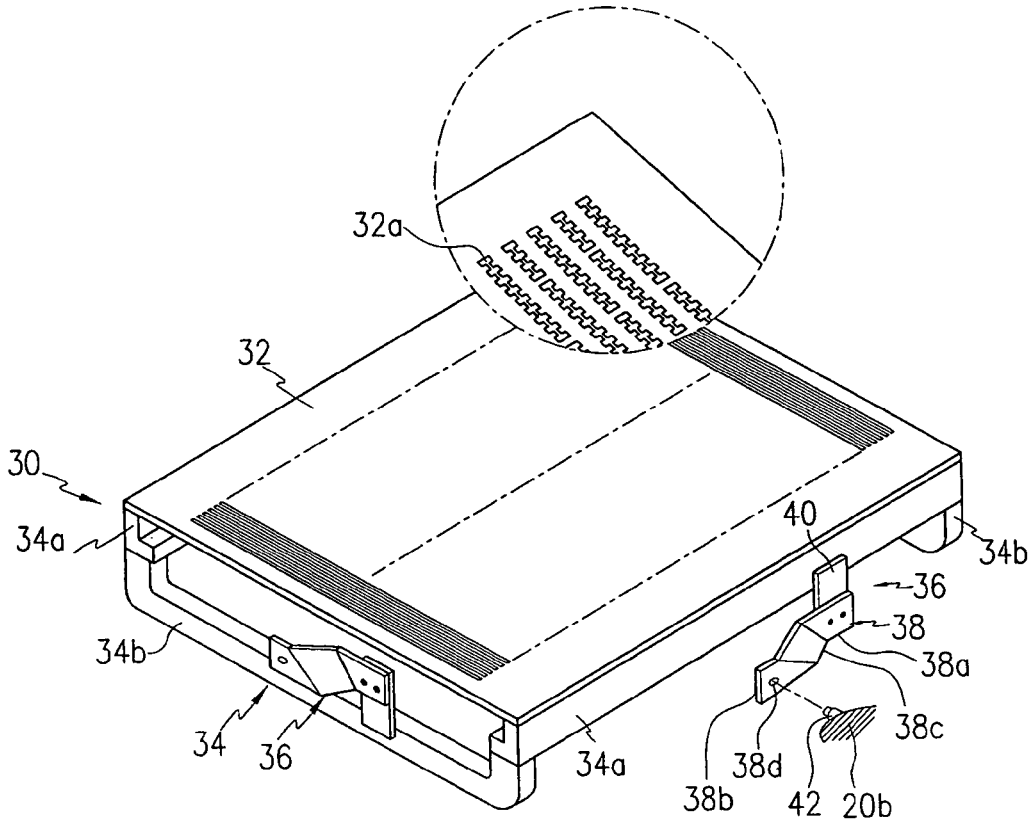
FIG. 2 is a perspective view of a color selection apparatus of FIG. 1 shown in a state where a support member is mounted to the color selection apparatus.

Further, a color selection apparatus 30 is mounted in the vacuum tube assembly at a predetermined location between the phosphor screen 21 and the electron gun 28. The color selection apparatus 30 performs color separation of a plurality of electron beams (R, G, and B electron beams) emitted from the electron gun 28. With reference to FIGS. 1 and 2, the color selection apparatus 30 includes a mask 32 that has a plurality of electron beam passage apertures 32*a* depicted in enlarged view FIG. 2 and is formed, for example, in a rectangular shape, with an array of rows and columns of aperture 32*a*, having a long axis and a short axis.

The color selection apparatus 30 also includes a frame 34 to which the mask 32 is mounted in a state of tension, that is, receiving a predetermined tension along either or both the long axis direction and the short axis direction. The frame 34 includes support members 34*a* provided at a predetermined distance from one another, and elastic members 34*b* extending from one support member 34*a* to the other support member 34*a* at each end of the Frame 34. The support members 34*a* and the elastic members 34*b* form a rectangular frame.

The mask 32 is welded to an upper surface (in FIG. 2) of each of the support members 34*a* in a state receiving tension along its short axis direction. The elastic members 34*b* are formed in a laterally-extended 'U' shape with ends connected to the support members 34*a*. The elastic members 34*b* provide the tension to the mask 32 through its connection to the support members 34*a*.

The color selection apparatus 30 structured as described above is mounted to the panel 20 such that the mask 32 faces the phosphor screen 21 and so that the color selection apparatus 30 is mostly surrounded by the panel 20. The mounting of the color selection apparatus 30 to the panel 20 is realized by support members 36. In one embodiment, the support members 36 are at each side of color selection apparatus 30 and support all four sides of the color selection apparatus 30 such that the color selection apparatus 30 is secured and mostly surrounded by the panel 20. However, alternative embodiments of the present invention, may not have a support member 36 at each side of the color selection apparatus 30. The areas of support and the number of support areas of the color selection apparatus 30 may be varied as needed.

The support members 36 are realized through springs 38 that are connected to the color selection apparatus 30 and to the panel 20. In more detail, with reference to FIGS. 2 and 3, the springs 38 are formed of thin plate-shaped members and each include a fixed section 38*a* secured to the mask frame 34 of the color selection apparatus 30, a locking section 38*b* connected to an inside surface of the panel 20, and a center section 38*c* formed between the fixed section 38*a* and the center section 38*c*.

The fixed sections 38*a* of the springs 38 may be secured either to the support members 34*a* or the elastic members 34*b* of the mask frame 34 as depicted in FIG. 2 at the right and left sides of frame 34. In the embodiment, each of the fixed sections 38*a* is secured to the mask frame 34 through a holder 40. That is, the holders 40 are fixed by welding to the support members 34*a* or the elastic members 34*b* of the mask frame 34, and the fixed sections 38*a* of the springs 38 are welded to the holders 40.

Stud pins 42 are fixedly extending into the vacuum tube assembly from the side wall 20*b* of the panel 20. Each of the locking sections 38*b* includes a connecting hole 38*d* into which one of the stud pins 42 is inserted for connection to the side wall 20*b* of the panel 20. The stud pins 42 are cylindrical and the connecting holes 38*d* are formed corresponding to the shape of the stud pins 42. However, other shapes of stud pins 42 and holes 38*d* may be used as needed.

Figure 3:
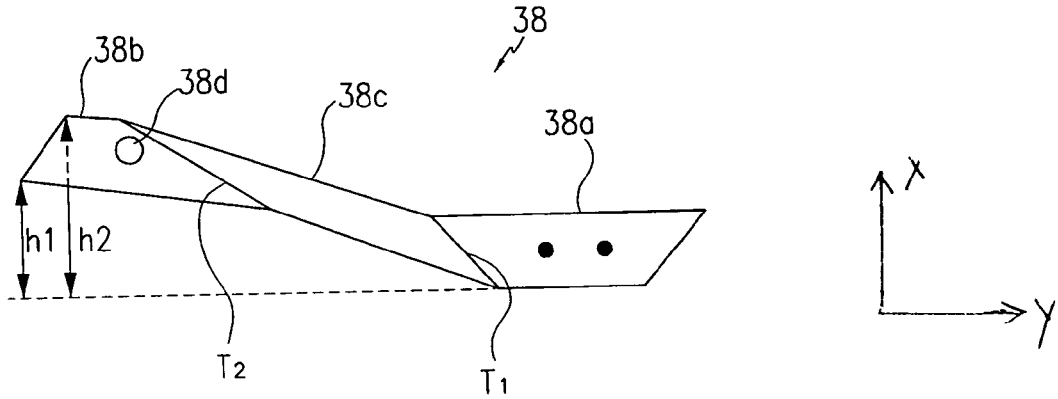
FIG. 3 is a perspective view of a spring of FIG. 1.

The fixed section 38*a*, the locking section 38*b*, and the center section 38*c* of each of the springs 38 are separated by a plurality of folding traces. Referring to FIG. 3 which shows the spring from the opposite side of that shown in FIG. 2, in each of the springs 38, the fixed section 38*a* and the center section 38*c* are separated by a first folding trace $T_1$, and the center section 38*c* and the locking section 38*b* are separated by a second folding trace $T_2$. A predetermined angle is formed between the fixed section 38*a* and the center section 38*c* at the first folding trace $T_1$, and a predetermined angle is formed between the center section 38*c* and the locking section 38*b* at the second folding trace $T_2$. In the embodiment, these angles at which the springs 38 are bent are in opposite directions within each of the springs 38. A stepped configuration results along a length of the springs 38 with such a structure.

If a direction along a width of the springs 38 is X and a direction along a length of the springs 38 is Y, as seen in FIGS. 4,5,6A and 6B, the folding traces $T_1$ and $T_2$ are formed on the springs 38 slanted at a predetermined angle with respect to straight lines $L_1$ and $L_2$ drawn along the direction X.

Figure 4:
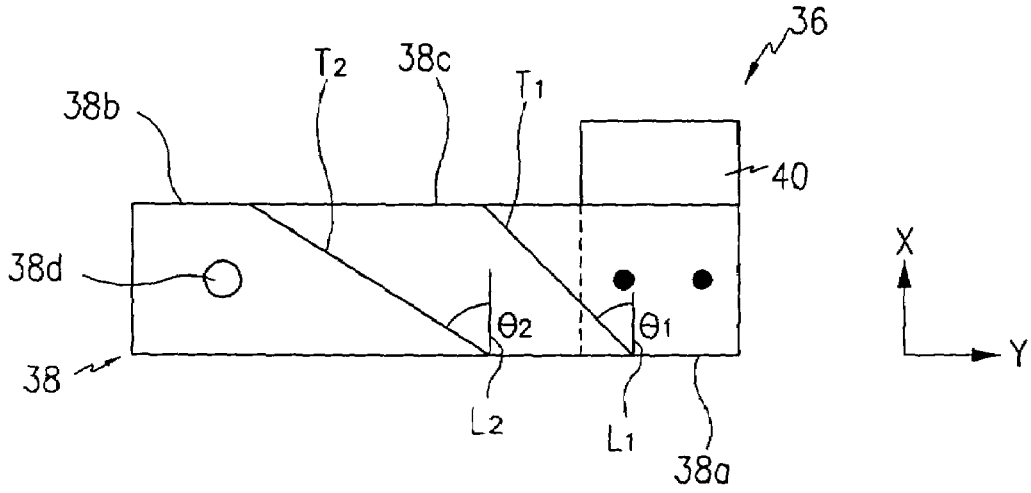
FIG. 4 is a perspective view of a spring of FIG. 1 shown in an unfolded state.

FIG. 4 shows one of the springs 38 in a state where it is not bent at the folding traces $T_1$ and $T_2$, and is instead unfolded in a straight line configuration. In this figure, the first folding trace $T_1$ has an angle $\theta_1$ with the straight line $L_1$ drawn on the fixed section 38*a*, and the second folding trace $T_2$ has an angle $\theta_2$ with the straight line $L_2$ drawn on the center section 38*c*. The angle $\theta_2$ is greater than the angle $\theta_1$.

When the color selection apparatus 30 undergoes thermal expansion by the landing of electron beams thereon during operation of the CRT, such a configuration allows for the springs 38 to compensate for any repositioning of the color selection apparatus 30 to prevent mislanding of the electron beams, and enables the locking sections 38*b* to be more parallel with the side wall 20*b* of the panel 20 to which the stud pins 42 are provided such that mounting of the springs 38 to the stud pins 42 is improved. The directions X and Y are defined with respect to an unfolded position of the spring 38 for convenience. However, directions X and Y and consequently, angles $\theta_1$ and $\theta_2$, stay the same when spring 38 is bent.

In one embodiment, the range of the angle $\theta_1$ is between 0 and 45 degrees, and the range of the angle $\theta_2$ is between 30 and 70 degrees, and the angle $\theta_2$ exceeds the angle $\theta_1$.

In one example, when $\theta_1$ and $\theta_2$ are in the prior mentioned ranges, $\theta_1$ is 45° and $\theta_2$ *is* 56°. Also, the distance h1 being along direction X of the spring 38 from a lowermost plane of the fixed section 38*a* to a corner of a lowermost plane of the locking section 38*b* and the distance h2 being along direction X of the spring 38 from the lowermost plane of the fixed section 38*a* to a corner of a uppermost plane of the locking section 38*b* have the following values: $h_1$=20.0 mm, $h_2$=22.9 mm, therefore, $h_2-h_1$ is 2.9 mm where, the difference in the lengths $h_2-h_1$ in an examplory embodiment is in the range:

$$1\ \text{mm} \leqq h_2-h_1 \leqq 5\ \text{mm}.$$

$\theta_1$, $\theta_2$, $h_1$ and $h_2$ of the springs 38 in the above ranges compensation to prevent mislanding of electron beams during operation of the CRT is improved through the moving of the frame 34. In one examplory embodiment, the mask 32 is moved toward the phosphor screen 21 by 5 μm, which is an improvement over the prior art).

Figure 5:
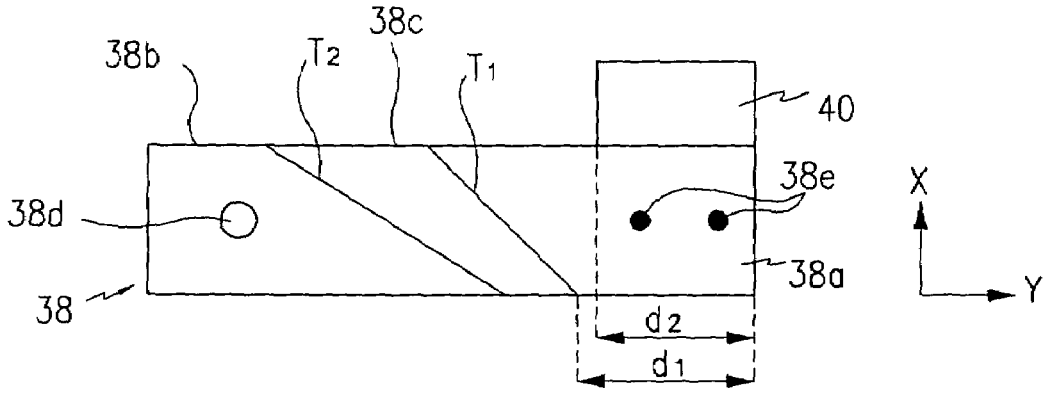
FIG. 5 is a perspective view of a first modified example of a spring of FIG. 1, the spring being shown in an unfolded state.

FIG. 5 shows a first modified example of one of the springs 38, and as in FIG. 4, the spring 38 is shown in a state where it is not bent at the folding traces $T_1$ and $T_2$, and is instead unfolded in a straight line configuration.

The spring 38 of the first modified example which has $\theta_1$, $\theta_2$, $h_1$ and $h_2$ in the ranges described above. However, the first folding trace $T_1$ is moved toward the locking section 38*b*. With this example, a distance $d_1$ from an end 38*a* of the fixed section 38*a* to the first folding trace $T_1$ is greater than a distance $d_2$ from the end 38*a* of the fixed section 38*a* to an edge of the holder 40 which is the furthermost end 38*a* of the fixed section 38*a*. The first folding trace $T_1$ also does not enter into the region of the fixed section 38*a*.

With the spring 38 formed in this manner, since the first folding trace $T_1$ is distanced from the edge of holder 40 and where the fixed section 38*a* and the holder 40 are connected, and from welding points 38*e* between these two elements, the movement of the fixed section 38*a* that moves about the welding points 38*e* is increased. As a result, prevention of mislanding of electron beams is further improved.

Figure 6A:
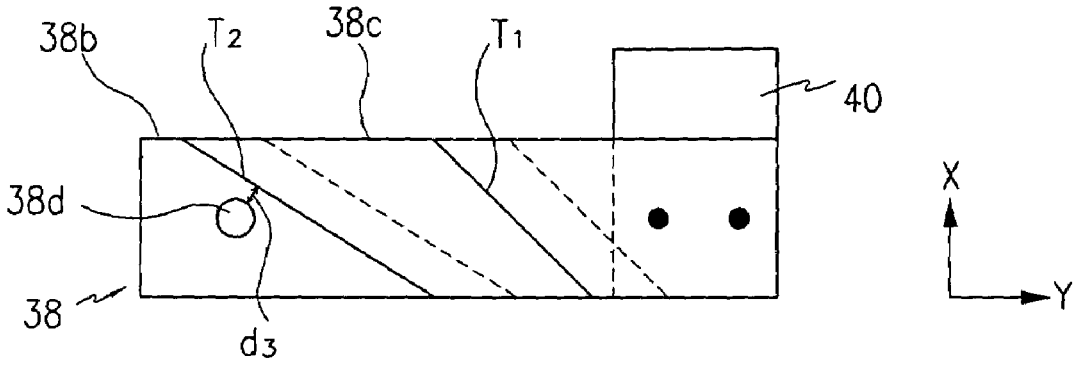
FIGS. 6A and 6B are perspective views of a second modified example of a spring of FIG. 1, the spring being shown in an unfolded state.
Figure 6B:
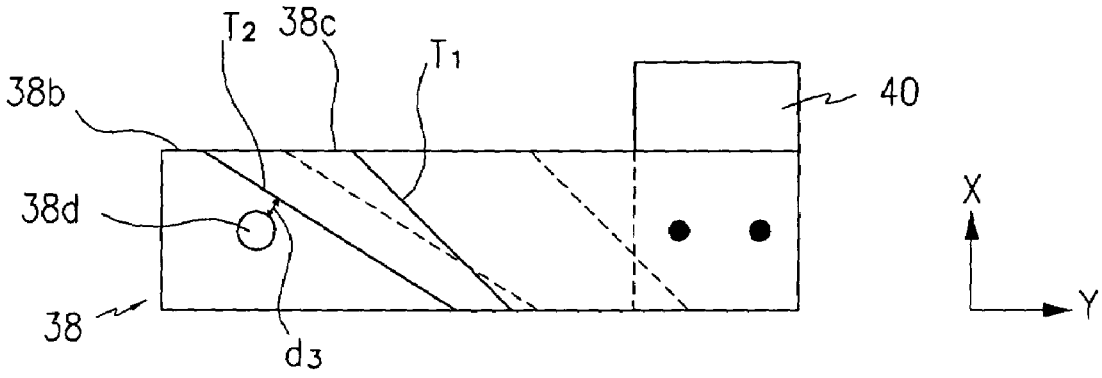

FIGS. 6A and 6B show further examples of the springs 38, and as in FIGS. 4 and 5, the springs 38 is shown in a state where they are not bent at the folding traces $T_1$ and $T_2$, and instead are shown unfolded in a straight line configuration.

In the spring 38, distance $d_3$ is along a straight line that passes through a center of the connecting hole 38*d* and perpendicular to the second folding trace $T_2$ and is at least 5 mm in length. This allows for easy connection of the locking section 38*b* to the corresponding stud pin 42, that is, easy insertion of the stud pin 42 into the connecting hole 38*d* of the locking section 38*b*.

Table 1 below shows the measurement results of misleading movement amounts of electron beams in the CRT is an example of the present invention and is one prior art device at both low and high temperatures.

[Table 1]

| | Present Invention (μm/° C.) | Prior Art (μm/° C.) |
|---|---|---|
| Low temperature (−10° C.) | 1.21 | 0.83 |
| High temperature (45° C.) | 1.25 | 1.02 |

Although an embodiment of the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A cathode ray tube including a color selection apparatus mounted between a phosphor screen and an electron gun installed within a vacuum tube assembly of the cathode ray tube, and one or more support members for supporting the color selection apparatus in the vacuum tube assembly, each of the one or more support members being formed by a spring comprising:

a fixed section secured to the color selection apparatus;

a locking section connected to the vacuum tube assembly; and a center section formed between the fixed section and the locking section, wherein the fixed section and the center section are separated by a bend at a first folding trace, and the center section and the locking section are separated by a bend at a second folding trace, wherein the spring is only bent between the locking section and the fixed section at the first folding trace and the second folding trace, and wherein if a direction along a width of the spring is X, a direction along a length of the springs is Y, the first folding trace has an angle $\theta_1$ with a straight line drawn on the fixed section along direction X, and the second folding trace has an angle $\theta_2$ with a straight line drawn on the center section along direction X, the angle $\theta_2$ is greater than the angle $\theta_1$.

2. The cathode ray tube of claim 1, wherein direction of bent between the fixed section and the center section is opposite to the direction of bent between the center section and the locking section.

3. The cathode ray tube of claim 1, wherein each of the one or more support members further comprises a holder that is fixed to the color selection apparatus and to the corresponding fixed section.

4. The cathode ray tube of claim 3, wherein the fixed section of each of the one or more support members is welded to the holder of the corresponding said spring.

5. The cathode ray tube of claim 3, wherein the first folding trace is formed to the outside of areas of the support members making contact with the holders.

6. The cathode ray tube of claim 1, wherein a connecting hole is formed in the locking section, and the connecting hole is secured to a stud pin mounted to an inner surface of the panel of the vacuum tube assembly.

7. The cathode ray tube of claim 1, wherein the angle $\theta_1$ satisfies the following condition:

$$0° < \theta_1 \leqq 45°.$$

8. The cathode ray tube of claim 1, wherein the angle $\theta_2$ satisfies the following condition:

$$30° \leqq \theta_2 \leqq 70°.$$

9. A cathode ray tube including a color selection apparatus mounted between a phosphor screen and an electron gun installed within a vacuum tube assembly of the cathode ray tube, and one or more support members for supporting the color selection apparatus in the vacuum tube assembly, each of the one or more support members being formed by a spring comprising:

a fixed section secured to the color selection apparatus;

a locking section connected to the vacuum tube assembly; and a center section formed between the fixed section and the locking section, wherein the fixed section and the center section are separated by and bent at a first folding trace, and the center section and the locking section are separated by and bent at a second folding trace, wherein if a direction along a width of the spring is X, a direction along a length of the springs is Y, the first folding trace has an angle $\theta_1$ with a straight line drawn on the fixed section along direction X, and the second folding trace has an angle $\theta_2$ with a straight line drawn on the center section along direction X, the angle $\theta_2$ is greater than the angle $\theta_1$, wherein a connecting hole is formed in the locking section, and the connecting hole is secured to a stud pin mounted to an inner surface of the panel of the vacuum tube assembly, and wherein the connecting hole is circular, and a distance of a straight line that passes through a center of the connecting hole and is perpendicular to the second folding trace is 5 mm or greater in length.

10. A cathode ray tube including a color selection apparatus mounted between a phosphor screen and an electron gun installed within a vacuum tube assembly of the cathode ray tube, and one or more support members for supporting the color selection apparatus in the vacuum tube assembly, each of the one or more support members being formed by a spring comprising:

a fixed section secured to the color selection apparatus;

a locking section connected to the vacuum tube assembly; and a center section formed between the fixed section and the locking section, wherein the fixed section and the center section are separated by and bent at a first folding trace, and the center section and the locking section are separated by and bent at a second folding trace, wherein if a direction along a width of the spring is X, a direction along a length of the springs is Y, the first folding trace has an angle $\theta_1$ with a straight line drawn on the fixed section along direction X, and the second folding trace has an angle $\theta_2$ with a straight line drawn on the center section along direction X, the angle $\theta_2$ is greater than the angle $\theta_1$, and wherein if a length along direction X of the spring from a plane of the fixed section to a corner of a plane of the locking section is h1, and a length along direction X of the springs from the plane of the fixed section to a corner of a plane of the locking section is h2, the following condition is satisfied:

$$1\ \text{mm} \leqq h_2 - h_1 \leqq 5\ \text{mm}.$$

11. A support member for supporting a color selection mounted within a vacuum tube assembly of a cathode ray tube comprising:

a fixed section secured to the color selection apparatus;

a locking section secured to the vacuum tube assembly; and a center section formed between the fixed section and the locking section, wherein a first fold connects the center section to the fix section and a second fold connects the center section to the locking section, wherein the support member is only bent between the locking section and the fixed section at the first fold and the second fold, and wherein an angle $\theta_1$ formed between the first fold and a straight line drawn on the fixed section along a direction X is smaller than an angle $\theta_2$ formed between the second fold and a straight line drawn on the center section along the direction X, where the X direction is along a width of the support member.

12. The support member of claim 11, wherein a bending direction between the fixed section and the center section is opposite to a bending direction between the center section and the locking section.

13. The support member of claim 11, further comprising a holder that is fixed to the color selection apparatus and to the corresponding fixed section.

14. The support member of claim 13, wherein the fixed section is welded to the holder.

15. The support member of claim 11, wherein a connecting hole is formed in the locking section, and the connecting hole is secured to a stud pin mounted to an inner surface of the panel of the vacuum tube assembly.

16. The support member of claim 11, wherein the angle $\theta_1$ satisfies the following condition:

$$0° < \theta_1 \leqq 45°.$$

17. The support member of claim 11, wherein the angle $\theta_2$ satisfies the following condition.

$$30° \leqq \theta_2 \leqq 70°.$$

18. A support member for supporting a color selection mounted within a vacuum tube assembly of a cathode ray tube comprising:

a fixed section secured to the color selection apparatus;

a locking section secured to the vacuum tube assembly; and a center section formed between the fixed section and the locking section, wherein the fixed section and the center section are separated by a first folding trace and are bent at the first folding trace, and the center section and the locking section are separated by a second folding trace and are bent at the second folding trace, and wherein an angle $\theta_1$ formed between the first folding trace and a straight line drawn on the fixed section along a direction X is smaller than an angle $\theta_2$ formed between the second folding trace and a straight line drawn on the center section along the direction X, where the X direction is along a width of the support member, wherein a connecting hole is formed in the locking section, and the connecting hole is secured to a stud pin mounted to an inner surface of the panel of the vacuum tube assembly, and wherein the connecting hole is circular, and a distance of a straight line that passes through a center of the connecting hole and is perpendicular to the second folding trace is 5 mm or greater in length.

19. A support member for supporting a color selection mounted within a vacuum tube assembly of a cathode ray tube comprising:

a fixed section secured to the color selection apparatus;

a locking section secured to the vacuum tube assembly; and a center section formed between the fixed section and the locking section, wherein the fixed section and the center section are separated by a first folding trace and are bent at the first folding trace, and the center section and the locking section are separated by a second folding trace and are bent at the second folding trace, and wherein an angle $\theta_1$ formed between the first folding trace and a straight line drawn on the fixed section along a direction X is smaller than an angle $\theta_2$ formed between the second folding trace and a straight line drawn on the center section along the direction X, where the X direction is along a width of the support member, wherein if a length along direction X of the support member from a plane of the fixed section to a corner of a plane of the locking section is h1, and a length along direction X of the springs from the plane of the fixed section to a corner of a plane of the locking section is h2, the following condition is satisfied:

$$1\ \text{mm} \leqq h_2 - h_1 \leqq 5\ \text{mm}.$$

* * * * *

UNITED STATES PATENT AND TRADEMARK OFFICE

CERTIFICATE OF CORRECTION

PATENT NO. : 7,067,968 B2
APPLICATION NO. : 10/627567
DATED : June 27, 2006
INVENTOR(S) : Ha et al.

It is certified that error appears in the above-identified patent and that said Letters Patent is hereby corrected as shown below:

| | |
|---|---|
| Column 7, line 44, Claim 1 | Delete “springs”,<br>Insert --spring-- |
| Column 7, line 51, Claim 2 | Delete “bent”,<br>Insert --bend-- |
| Column 7, line 52, Claim 2 | Delete “bent”,<br>Insert --bend-- |
| Column 8, line 28, Claim 9 | Delete “springs”,<br>Insert --spring-- |
| Column 8, line 59, Claim 10 | Delete “springs”,<br>Insert --spring-- |
| Column 8, line 68, Claim 10 | Delete “springs”,<br>Insert --spring-- |
| Column 9, line 14, Claim 11 | Delete “fix section”,<br>Insert --fixed section-- |

Signed and Sealed this

Sixth Day of March, 2007

JON W. DUDAS
*Director of the United States Patent and Trademark Office*